US008534805B2

(12) United States Patent
Sano

(10) Patent No.: US 8,534,805 B2
(45) Date of Patent: Sep. 17, 2013

(54) LIQUID DISCHARGE HEAD AND IMAGE FORMING APPARATUS

(75) Inventor: Takeshi Sano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 351 days.

(21) Appl. No.: 13/024,821

(22) Filed: Feb. 10, 2011

(65) Prior Publication Data

US 2011/0211021 A1 Sep. 1, 2011

(30) Foreign Application Priority Data

Feb. 26, 2010 (JP) ..... 2010-041826

(51) Int. Cl.
*B41J 2/045* (2006.01)

(52) U.S. Cl.
USPC ..... 347/72; 347/68; 347/70

(58) Field of Classification Search
None
See application file for complete search history.

(56) References Cited

U.S. PATENT DOCUMENTS 5,818,482 A * 10/1998 Ohta et al. ..... 347/70

FOREIGN PATENT DOCUMENTS

| | | |
|---|---|---|
| JP | 2000-351207 | 12/2000 |
| JP | 2002-292864 | * 10/2002 |
| JP | 2004-160941 | 6/2004 |

* cited by examiner

*Primary Examiner* — Geoffrey Mruk
(74) *Attorney, Agent, or Firm* — Cooper & Dunham LLP

(57) ABSTRACT

A disclosed liquid discharge head includes plural nozzles configured to discharge droplets; plural chambers in communication with the respective nozzles; a vibration plate member having a deformable vibration area configured to form a part of a wall surface of the chambers, a first projection in the deformable vibration area, and a second projection in a part corresponding to a partition wall between the chambers; and a piezoelectric member having a drive pillar bonded to the first projection and a non-drive pillar bonded to the second projection. A width of a base of the first projection is greater than a width of a base of the second projection, and a width of the drive pillar is less than a width of the non-drive pillar.

11 Claims, 13 Drawing Sheets

LIQUID DISCHARGE HEAD AND IMAGE FORMING APPARATUS

BACKGROUND OF THE INVENTION

1. Field of the Invention

The present invention particularly relates to a liquid discharge head having a vibrating plate member, and to an image forming apparatus.

2. Description of the Related Art

As an image forming apparatus such as a printer; a facsimile; a copying apparatus; a plotter; and a multifunction peripheral of these apparatuses, a liquid discharge recording type image forming apparatus using a recording head formed of, for example, a liquid discharge head (liquid droplet discharge head) that discharges ink droplets has been known. This liquid discharge recording type image forming apparatus performs image formation (recording, typing, imaging, and printing are used as synonyms) by discharging ink droplets from a recording head to a conveyed sheet (sheet is not limited to paper, but includes OHP (overhead projector) and the like, to which ink droplets, other liquid, and the like can attach. The sheet is also referred to as a medium to be recorded on, a recording medium, recording paper, a recording sheet, and the like). This liquid discharge recording type image forming apparatus includes a serial type image forming apparatus which forms images by discharging liquid droplets while moving a recording head in a main scanning direction, and a line type image forming apparatus using a line type head that forms images by discharging liquid droplets without moving a recording head.

In the present application, the liquid discharge recording type "image forming apparatus" means an apparatus that performs image formation by discharging liquid onto a medium such as paper, a string, a fiber, a cloth, a leather, metal, plastic, glass, wood, and ceramics. The "image formation" does not mean only to attach an image with a meaning such as text and a figure to a medium, but also to attach an image having no meaning such as a pattern to a medium (to simply land liquid droplets onto a medium). "Ink" is not limited to what is called an ink, but is used as a collective term for all liquid that can be used for image formation, such as what is called a recording solution, a fixation processing liquid, and a liquid. For example, a DNA sample, resist, a pattern material, resin, and the like are included in the "ink". Further, the "image" is not limited to be two-dimensional, but also includes an image attached to a three-dimensionally formed object or an image formed by three-dimensionally shaping a solid itself.

As a conventional liquid discharge head, what is called a piezoelectric head has been known. The piezoelectric head includes a piezoelectric body serving as a pressure generating unit for pressurizing ink as liquid in a liquid chamber, such as a piezoelectric actuator using a stacked-layer type piezoelectric element having piezoelectric layers and internal electrodes that are alternately stacked. The piezoelectric head deforms a deformable vibration area of a vibration plate member that forms a wall surface of the liquid chamber by a displacement in a d33 or d31 direction of the stacked-layer type piezoelectric element, so as to change volume and pressure in the liquid chamber to discharge liquid droplets.

Such a liquid discharge head using the stacked-layer type piezoelectric element has the following characteristics. Since the vibration plate member can be driven at high frequency, individual liquid droplets can be landed as an aggregate. Since the size of the droplets to be discharged can be controlled from small droplets to large droplets, high quality printing can be performed at high speed.

In order to realize an image forming apparatus aiming for higher quality printing at higher speed, there has been a demand to arrange nozzles for discharging liquid droplets at a high density. However, in realizing a high density of the head using the stacked-layer type piezoelectric elements, so-called mutual interference is a problem. The mutual interference occurs such that, when a vibration area (diaphragm part) of a vibration plate member is displaced for discharging droplets, pressure fluctuation propagates to an adjacent liquid chamber, whereby droplets are discharged by the adjacent chamber unstably, or liquid dripping occurs from a nozzle when the adjacent chamber does not discharge droplets.

In view of these problems, a structure has been conventionally known (Patent Document 1) in which a pillar type piezoelectric element (drive pillar) for applying a driving signal to a piezoelectric member and a pillar type piezoelectric element (non-drive pillar) that does not apply a driving signal but serves as a support member are alternately arranged so that non-drive pillar supports a partition wall between liquid chambers. In this case, the drive pillar and non-drive pillar are used separately as follows by forming grooves in a stacked-layer type piezoelectric member. The drive pillar is formed to pressurize a liquid chamber for discharging droplets. The non-drive pillar is arranged at a position opposing a partition wall of a channel plate constituting the liquid chamber.

Further, to prevent the non-drive pillar from being extended by a force applied by the drive pillar when the drive pillar is driven, there have been known, for example, the following techniques to increase rigidity of the non-drive pillar. The non-drive pillar is formed of a material with an elastic coefficient greater than that of the drive pillar, a cross-sectional area of the non-drive pillar is formed greater than that of the drive pillar, or the cross-sectional area of the non-drive pillar is formed to be larger at the side farther from a vibration plate (Patent Document 2).

In addition, it has also been known to connect one of inactive areas positioned at opposite ends of a stacked-layer type piezoelectric element in a longitudinal direction of a pressure liquid chamber, via a vibration plate, to a pressure liquid chamber substrate (Patent Document 3).

[Patent Document 1]

Japanese Patent Application Publication No. 2002-292864

[Patent Document 2]

Japanese Patent Application Publication No. 2000-351207

[Patent Document 3]

Japanese Patent Application Publication No. 2004-160941

In a high density head having nozzles aligned at a high density, a pitch of grooves formed in a stacked-layer type piezoelectric element (piezoelectric member) becomes narrow. In addition, widths of the drive pillar and non-drive pillar (width in a direction in which the nozzles are aligned (hereinafter also referred to as "nozzle alignment direction"), the same applies below) also become narrow.

In this case, since the volumes of individual liquid chambers that are in communication with the nozzles become small, droplets have to be discharged at high efficiency. To discharge the droplets at high efficiency, a displacement amount of a diaphragm part of a vibration plate member has to be increased in order to generate high pressure in the liquid chamber by a low voltage drive. To increase the displacement amount of the diaphragm part of the vibration plate member, at least one of the following has to be increased: a displacement amount of a stacked-layer type piezoelectric element, namely, the number of active stacked layers; or an area which applies pressure to a vibration plate.

However, in forming the grooves in a stacked-layer type piezoelectric element, a depth of the groove to be processed is limited. Therefore, it is difficult to increase the number of stacked active layers.

On the other hand, it has become clear that the mutual interference is caused when the non-drive pillar undergoes an extensional deformation since the non-drive pillar is narrow and the rigidity of the non-drive pillar is decreased with respect to a deformation force caused by a diaphragm part of a vibration plate member deformed by a displacement of the drive pillar; thus the non-drive pillar cannot avoid the deformation. To suppress this extensional deformation of the non-drive pillar, it has been known to apply a staged-groove process, by which staged grooves are formed, in order to increase a cross-sectional area of the non-drive pillar, namely the width of the non-drive pillar as disclosed in Patent Document 2. However, if such a staged-groove process is applied, there is a problem in that a high density cannot be substantially realized.

Regarding a countermeasure for the mutual interference, it has been clarified that the technique disclosed in Patent Document 3 cannot prevent deformation of the non-drive pillar at a high density.

SUMMARY OF THE INVENTION

The present invention is made in view of the above problems, and it is an object of at least one embodiment of the present invention to increase a displacement area of a vibration area vibrated by a drive pillar, and enable a stable discharge of droplets with a high density arrangement while suppressing mutual interference.

According to one aspect of the invention, a liquid discharge head includes plural nozzles configured to discharge liquid droplets; plural liquid chambers in communication with the respective nozzles; a vibration plate member having a deformable vibration area configured to form a part of a wall surface of the liquid chambers, a first projection part provided in the deformable vibration area, and a second projection part provided in a part corresponding to a partition wall between the liquid chambers; and a piezoelectric member having a drive pillar and a non-drive pillar, the drive pillar being bonded to the first projection part, and the non-drive pillar being bonded to the second projection part. A width in a direction in which the nozzles are aligned of a base part of the first projection part is greater than a width in the direction in which the nozzles are aligned of a base part of the second projection part, and a width in the direction in which the nozzles are aligned of the drive pillar is less than a width in the direction in which the nozzles are aligned of the non-drive pillar.

DETAILED DESCRIPTION OF THE PREFERRED EMBODIMENTS

Figure 1:
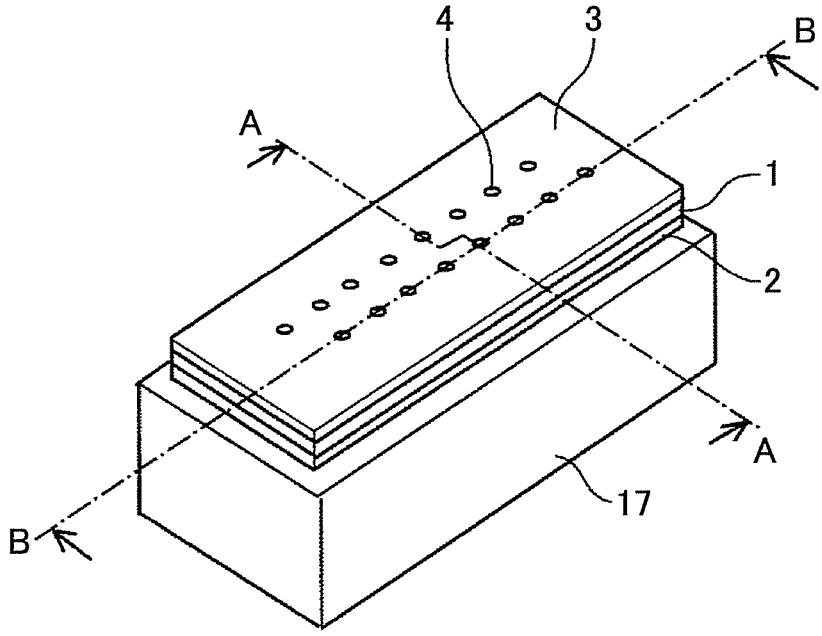
FIG. 1 is an exterior perspective view of a liquid discharge head according to a first embodiment of the present invention.
Figure 2:
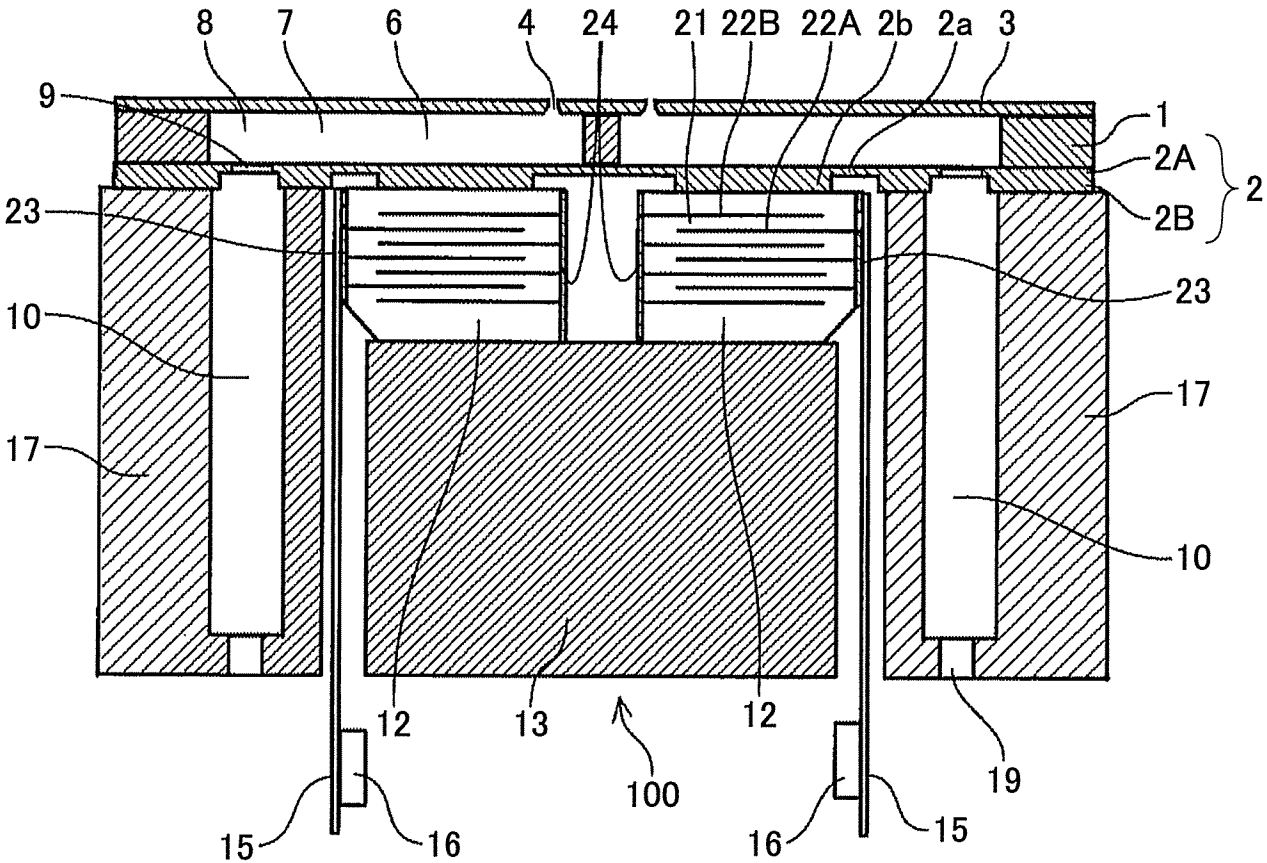
FIG. 2 is a cross-sectional view taken along a line A-A in FIG. 1.
Figure 3:
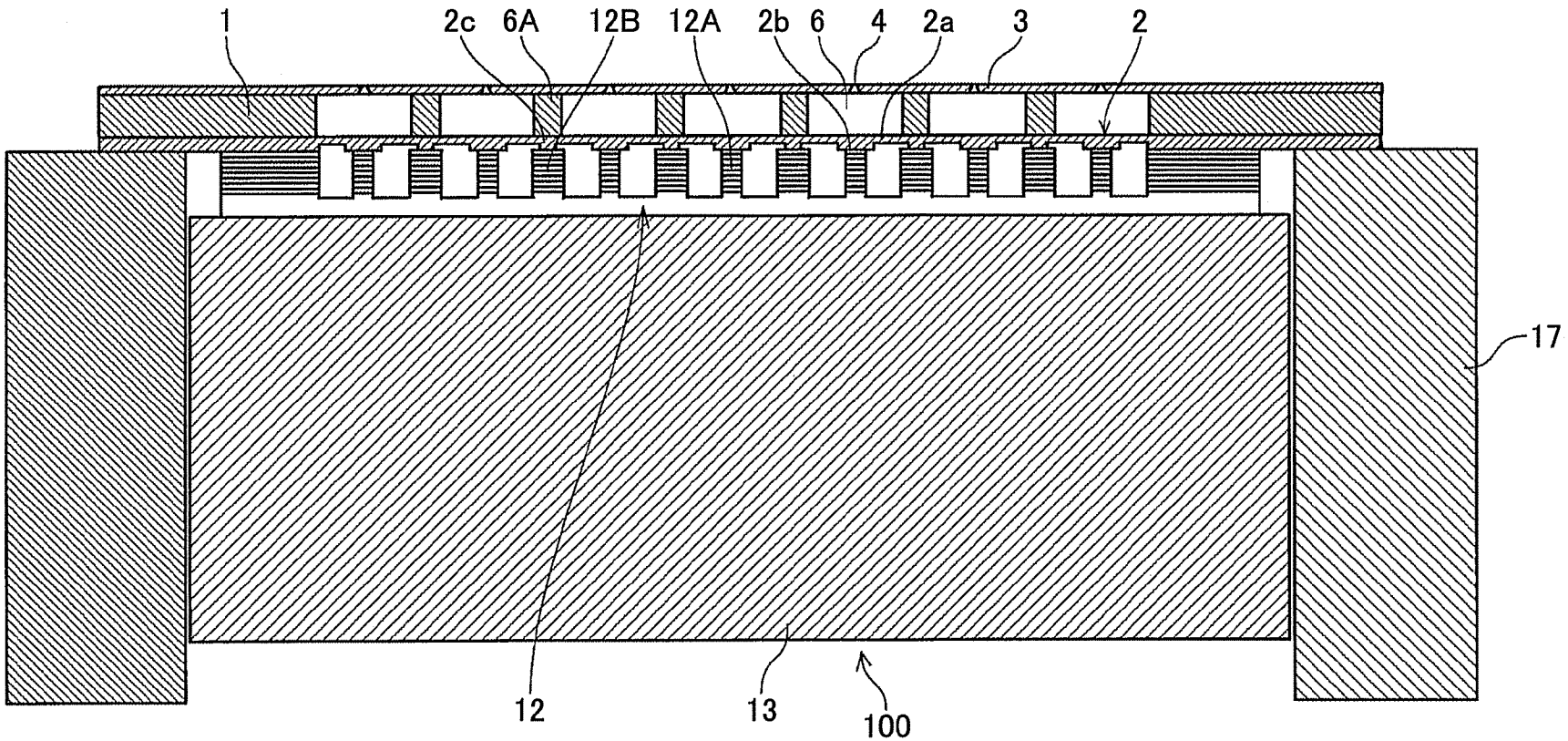
FIG. 3 is a cross-sectional view taken along a line B-B in FIG. 1.

Embodiments of the present invention are described below with reference to the attached drawings. A first embodiment of a liquid discharge head according to the present invention is described with reference to FIGS. 1 through 3. Note that FIG. 1 is an exterior perspective view of the liquid discharge head, FIG. 2 is a cross-sectional view taken along a direction perpendicular to a nozzle alignment direction of the liquid discharge head (longitudinal direction of a liquid chamber: the line A-A in FIG. 1), and FIG. 3 is a cross-sectional view taken along the nozzle alignment direction of the liquid discharge head (short direction of a liquid chamber: the line B-B in FIG. 1).

This liquid discharge head includes a channel plate 1 (also referred to as a channel member, a channel substrate, a liquid chamber substrate, and the like) formed of a SUS (Steel Use Stainless) substrate, a vibration plate member 2 that forms a vibration plate bonded to a lower surface of the channel plate 1, and a nozzle plate 3 bonded to an upper surface of the channel plate 1. These members form plural liquid chambers 6 (also referred to as pressurizing liquid chambers, pressure chambers, pressurizing chambers, channels, and the like) serving as individual channels that are in communication with corresponding nozzles 4 for discharging liquid droplets (droplets of liquid), fluid resistance parts 7 that also function as supply paths for supplying ink to the corresponding liquid chambers 6, and communication parts 8 that are in communication with the corresponding liquid chambers 6 via the fluid resistance parts 7. Ink is supplied from a common liquid chamber 10 formed in a frame member 17 described below via supply inlets 9 formed in the vibration plate member 2 into the corresponding communication parts 8.

In the channel plate 1, openings of the pressurizing liquid chambers 6, fluid resistance parts 7, and the like are formed by mechanically processing the SUS substrate by etching using an acid etching solution, punching (pressing), or the like. Note that the channel plate 1 can be formed by etching, for example, a single crystalline silicon substrate.

The vibration plate member 2 is formed of a first layer 2A and a second layer 2B. The first layer 2A forms a thin wall part, while the first layer 2A and second layer 2B form a thick wall part. The vibration plate member 2 includes vibration areas (diaphragm parts) 2*a* formed of the first layer 2A that forms wall surfaces of the liquid chambers 6, so as to correspond to the respective liquid chambers 6. A first projection part 2*b*, which is an island-shaped projection part formed of the thick wall part constituted by the first layer 2A and second layer 2B, is provided in the vibration area 2*a* on an out-of-plane side (on an opposite surface side to the liquid chamber 6). A piezoelectric actuator 100 including an electromechanical transducer serving as a driving unit (actuator unit, pressure generating unit) for causing the first projection part 2*b* to deform the vibration area 2*a* is arranged.

The piezoelectric actuator 100 includes plural (two, in this case) stacked-layer type piezoelectric members 12 bonded on a base member 13 by an adhesive. Grooves are formed in the piezoelectric member 12 by half-cut dicing, so that desired numbers of piezoelectric element pillars 12A and 12B are formed in a comb-like manner at a predetermined interval for one piezoelectric member 12. Note that the piezoelectric element pillars 12A and 12B of the piezoelectric member 12 are distinguished from each other as follows. A piezoelectric element pillar driven by an application of a driving waveform is the drive piezoelectric element pillar (drive pillar) 12A. A piezoelectric element pillar used simply as a support pillar without having applied a driving waveform is the non-drive piezoelectric element pillar (non-drive pillar) 12B.

An upper end surface (surface to be bonded) of the drive piezoelectric element pillar 12A is bonded to the first projection part 2*b* of the vibration plate member 2. An upper end surface of the non-drive piezoelectric element pillar 12B is bonded to a second projection part 2*c* that is the thick wall part of the vibration plate member 2, at a position corresponding to a partition wall 6A between the liquid chambers 6.

Here, the piezoelectric member 12 is formed by alternately stacking piezoelectric material layers 21, and internal electrodes 22A and 22B. The internal electrodes 22A and 22B are drawn out to respective end surfaces, namely side surfaces (surfaces along a direction in which the layers are stacked, also referred to as a layer-stacked direction) of the piezoelectric member 12, which side surfaces are substantially perpendicular to the vibration plate member 2, so that the internal electrodes 22A and 22B are connected to an individual external electrode 23 and a common external electrode 24, respectively, which serve as end surface electrodes formed on the side surfaces. By applying a voltage between the external electrodes 23 and 24, a displacement of the piezoelectric member 12 is caused in the layer-stacked direction. Note that the common external electrode 24 is drawn out through an internal electrode provided in a non-drive area to an end surface on the individual external electrode 23 side, which is an end part of the piezoelectric member 12.

An FPC (flexible printed circuit) 15 is connected to the piezoelectric member 12. The FPC 15 is a flexible wiring substrate that serves as a flexible power feeding member (wiring member) for supplying driving signals to the drive piezoelectric element pillar 12A. A driver IC (integrated circuit) 16, which is a driver circuit for supplying a driving waveform to the drive piezoelectric element pillar 12A, is mounted on the FPC 15.

Note that the piezoelectric element pillars 12A and 12B of the piezoelectric member 12 are formed of one piezoelectric member 12 here. However, the piezoelectric element pillar driven by an application of a driving waveform is used as the drive piezoelectric element pillar (drive pillar) 12A and the piezoelectric element pillar used simply as a support pillar without having applied a driving waveform is used as the non-drive piezoelectric element pillar (non-drive pillar) 12B. A width of the drive piezoelectric element pillar (drive pillar) 12A in a nozzle alignment direction is formed less than that of the non-drive piezoelectric element pillar (non-drive pillar) 12B. The drive piezoelectric element pillar 12A and the piezoelectric element pillar 12B used as a support pillar are alternately used to form a bi-pitch configuration.

The nozzle plate 3 is formed of a nickel (Ni) metal plate, and manufactured by an electroforming method. The nozzles 4 with a diameter of 10 to 35 μm are formed in this nozzle plate 3 so as to correspond to the respective liquid chambers 6, and the nozzle plate 3 is bonded to the channel plate 1 by an adhesive. A surface of the nozzle plate 3 from which liquid droplets are discharged (a surface of a discharge direction, a discharge surface, or a surface opposite to (away from) the liquid chamber 6 side) is provided with a repellent layer.

Further, on an outer peripheral side of the piezoelectric actuator 100 formed of the piezoelectric element 12, the base member 13, the FPC 15, and the like, the frame member 17 formed of an epoxy resin or polyphenylene sulfide by injection molding is bonded. The above-described common liquid chamber 10 is formed in the frame member 17. Further, a supply inlet 19 for supplying ink from outside into the common liquid chamber 10 is formed in the frame member 17. The supply inlet 19 is further connected to an ink supply source (not illustrated) such as a sub-tank or an ink cartridge.

In the case where the liquid discharge head configured in this manner is driven by, for example, a press-discharge method, a driving pulsed voltage of 20 to 50 V is selectively applied from a control part (not illustrated) to the drive piezoelectric element pillar 12A depending on an image to be recorded. The piezoelectric element pillar 12A to which the pulsed voltage is applied is displaced and deforms the vibration area 2*a* of the vibration plate 2 in a direction of the nozzle plate 3. When the content (volume) of the liquid chamber 6 is changed to pressurize the liquid in the liquid chamber 6, a liquid droplet is discharged from the nozzle 4 of the nozzle plate 3. In accordance with the discharge of the liquid droplets, a pressure in the liquid chamber 6 is decreased. Due to the inertia of the flow of liquid at this time, a slight negative pressure is generated in the liquid chamber 6. By turning off the voltage applied to the piezoelectric element pillar 12A in this state, the vibration plate 2 returns to its original position and the liquid chamber 6 returns to its original shape, whereby a negative pressure is further generated. At this time, ink is filled from the common liquid chamber 10 into the liquid chamber 6. In response to a next application of a driving pulse, a liquid droplet is discharged from the nozzle 4.

In addition to the press-discharge method described above, the liquid discharge head can be driven by a draw-discharge method (the vibration plate member 2 in a drawn state is released to generate a restoring force for pressurizing), a draw-press-discharge method (the vibration plate member 2 held at an intermediate position is drawn from the intermediate position and then pressed out), and the like.

Figure 4:
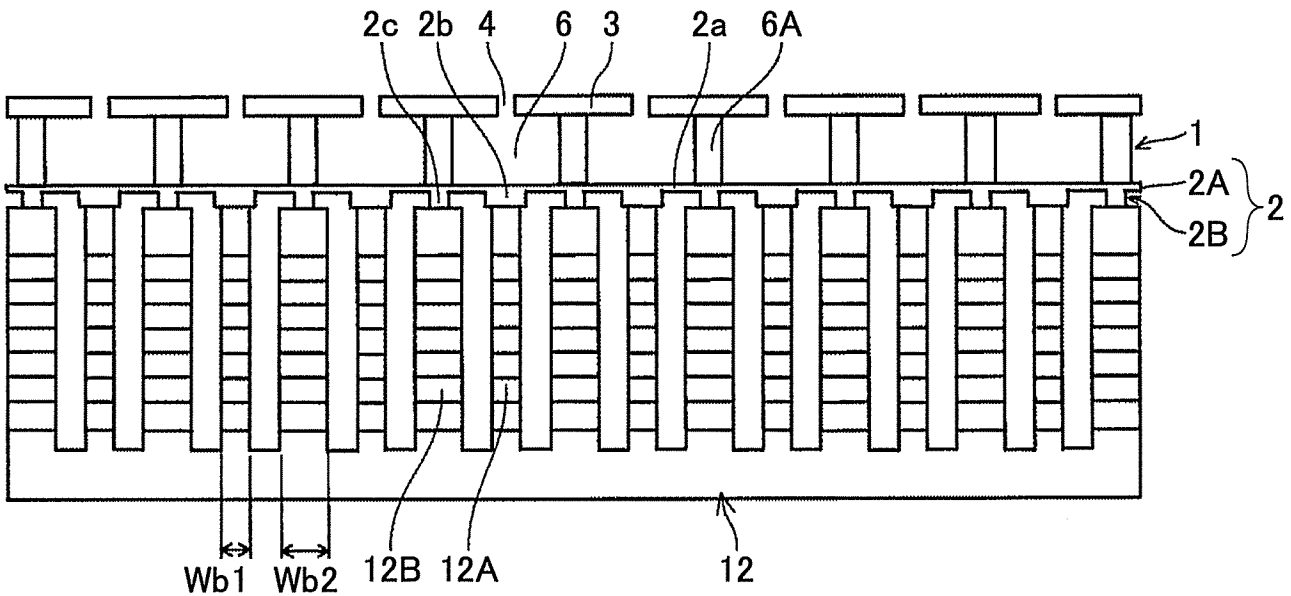
FIG. 4 is a cross-sectional view of a main part of the liquid discharge head illustrated in FIG. 1.

The details of the vibration plate member 2 in this liquid discharge head are described with reference to FIGS. 4 and 5. Note that FIG. 4 is a cross-sectional view of a main part taken along the nozzle alignment direction, and FIG. 5 is an enlarged cross-sectional view of a main part of the vibration plate member 2.

The vibration plate member 2 has a two-layer structure including the first layer 2A that is the thin wall part forming the diaphragm part 2*a*, and the second layer 2B forming the first projection part 2*b* of the diaphragm part 2*a* and a second projection part 2*c* provided corresponding to the partition wall 6A between the liquid chambers 6, which are the thick wall parts.

Figure 5:
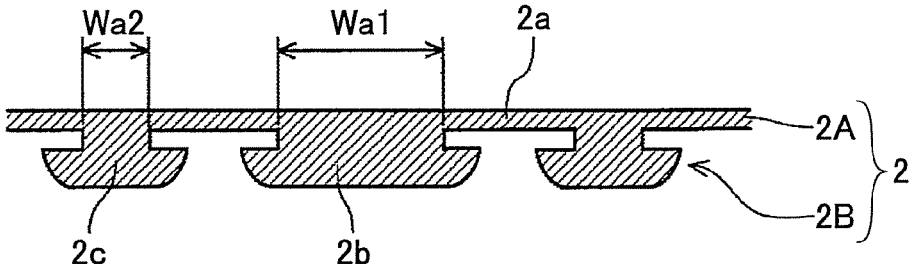
FIG. 5 is an enlarged cross-sectional view of a main part of a vibration plate member of the liquid discharge head illustrated in FIG. 1.

As illustrated in FIG. 5, a width Wa1 in the nozzle alignment direction of a base part of the first projection part 2*b* to which the drive piezoelectric element pillar 12A of the piezoelectric member 12 is bonded, is formed greater than a width Wa2 in the nozzle alignment direction of a base part of the second projection part 2*c* to which the non-drive piezoelectric element pillar 12B is bonded (Wa1>Wa2). Note that the "width of a base part" means a width of a boundary part of the projection part with the thin wall part (the first layer 2A in this example) on which the projection part is formed. That is, the "width of a base part" means a width of an area, on which the projection part is formed, of the thin wall part.

Figure 6A:
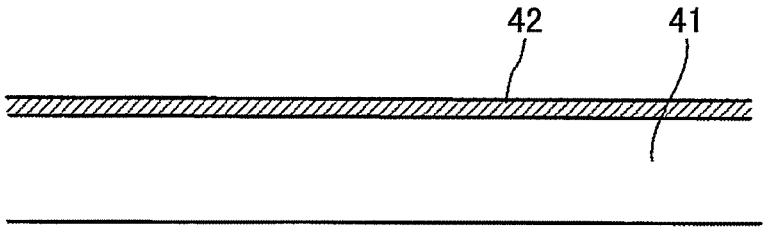
FIGS. 6A through 6F are views for describing an example of manufacturing steps of the vibration plate member illustrated in FIG. 5.
Figure 6B:
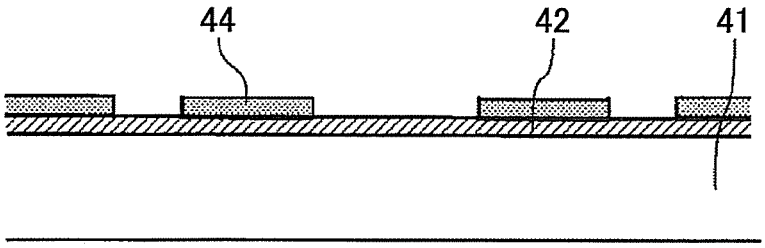
Figure 6C:
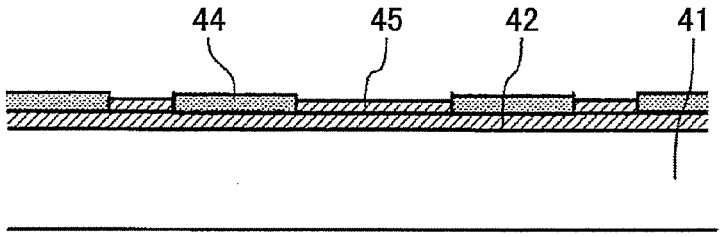
Figure 6D:
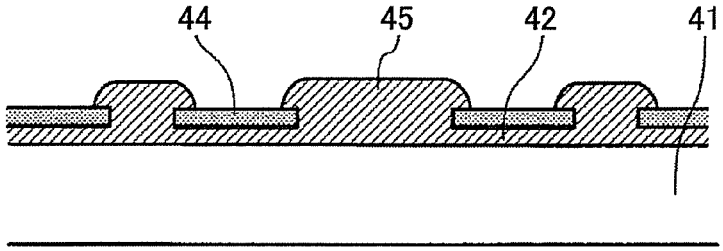
Figure 6E:
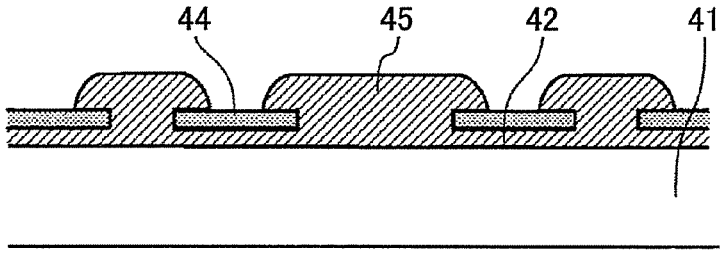
Figure 6F:
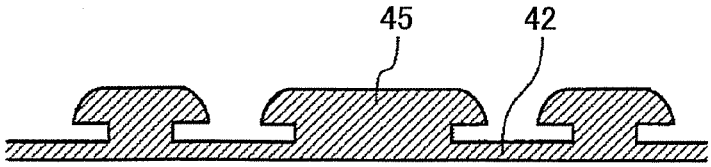

The vibration plate member 2 is formed by the electroforming method. This method is described with reference to FIGS. 6A through 6F. As illustrated in FIG. 6A, a first layer 42 (2A) to form the thin wall part (diaphragm part) 2*a* is formed on an electroforming support substrate 41. As illustrated in FIG. 6B, a resist pattern 44 having windows at parts corresponding to the thick wall parts (first projection part 2*b* and second projection part 2*c*) is formed, on which, for example, nickel electroforming is performed. As illustrated in FIG. 6C, nickel is deposited and accumulated on the first layer 42, whereby a nickel layer 45 is formed. When the nickel layer 45 grows to protrude from the windows as illustrated in FIG. 6D by further continuing the electroforming, the nickel layer 45 is enlarged in surface directions of the resist pattern 44 by an edge effect, whereby what is called overhang parts are generated. When this process is continued, the nickel layer 45 further extends in a thickness direction and a plane surface direction as illustrated in FIG. 6E. By removing the resist pattern 44 after the electroforming is finished in a predetermined growth stage, a metal film (plating film) provided with island-shaped thick wall parts (first projection part 2*b* and second projection part 2*c*) with a tack-shaped cross section, which is surrounded by recess parts, is obtained as illustrated in FIG. 6F.

By using such a manufacturing method, the thin wall part that constitutes the diaphragm part 2*a* of the vibration plate member 2 and the thick wall parts that form the first and second projection parts 2*b* and 2*c* can be manufactured by the same steps. Further, since photolithography can be used for forming a pattern of the thick wall parts, high pattern precision can be obtained.

Meanwhile, in FIG. 4, a width Wb2 in the nozzle alignment direction of the non-drive piezoelectric element pillar 12B bonded to the second projection part 2*c* is formed greater than a width Wb1 in the nozzle alignment direction of the drive piezoelectric element pillar 12A bonded to the first projection part 2*b* (Wb2>Wb1).

A relationship between the width Wa1 of the base part of the first projection part 2*b* and the width Wb1 of the drive piezoelectric element pillar 12A is Wa1>Wb1. With this relationship, a wider area can be deformed even with the narrow drive piezoelectric element pillar 12A, whereby a displacement volume can be increased.

In this manner, the width Wa1 of the base part of the first projection part 2*b*, which is bonded to the drive piezoelectric element pillar 12A of the vibration plate member 2, is formed greater than the width Wa2 of the base part of the second projection part 2*c* bonded to the non-drive piezoelectric element pillar 12B (Wa1>Wa2), and the width of the drive piezoelectric element pillar 12A in the nozzle alignment direction is formed less than the width of the non-drive piezoelectric element pillar 12B. As a result, a sufficient displacement of the diaphragm part 2*a* can be ensured, and discharge efficiency can be increased even when the drive piezoelectric element pillar 12A has a narrow width.

Since the width of the drive piezoelectric element pillar 12A can be reduced, the width of the non-drive piezoelectric element pillar 12B can be relatively increased. Therefore, occurrence of the mutual interference can be suppressed because the rigidity of the non-drive piezoelectric element pillar 12B can be enhanced. In this case, even when the width Wa2 of the base part of the second projection part 2*c* is reduced, there are few influences on the rigidity and a displacement of the partition wall part can be suppressed because a height (thickness) of the projection part is less (thinner) than that of the piezoelectric element pillar.

Next, a description is made in detail. Here, a head having the nozzles 4 aligned at about 600 dpi is manufactured. To manufacture such a head, grooves with a depth of 350 μm are processed by using a dicing blade with a thickness of 18 μm with respect to the stacked-layer type piezoelectric member 12 having twelve piezoelectric layers 21, so that the drive piezoelectric element pillars 12A with the width Wb1 of about 19 μm and the non-drive piezoelectric element pillars 12B with the width Wb2 of about 25 μm are alternately formed. Further, the vibration plate member 2 is formed by nickel electroforming, whereby the diaphragm part 2*a* (first layer 2A) with a thickness of about 2.5 μm and thick wall parts (second layer 2B) such as the first and second projection parts 2*b* and 2*c* with a thickness of about 15 μm are formed. By combining these members, the channel plate, the nozzle plate, and the like, an inkjet head is fabricated.

Here, heads 1 through 4 were manufactured and ink droplet discharge characteristics of the heads were evaluated. Table 1 shows combinations of the width Wa1 (section of drive pillar in Table 1) of the base part of the first projection part 2*b* and the width Wa2 (section of non-drive pillar in Table 1) of the base part of the second projection part 2*c* of the vibration plate member 2, which are bonded to the drive piezoelectric element pillar (drive pillar) 12A and the non-drive piezoelectric element pillar (non-drive pillar) 12B, respectively, of the heads 1 through 4. Note that the widths Wb1 and Wb2 are fixed.

TABLE 1

| | Width (μm) of base part of projection part of vibration plate | |
|---|---|---|
| Head No. | Part bonded to drive pillar | Part bonded to non-drive pillar |
| 1 | 25 | 15 |
| 2 | 15 | 15 |
| 3 | 15 | 25 |
| 4 | 25 | 25 |

As a result of the evaluations of the ink droplet discharge characteristics, the head 1 could suppress the mutual interference to 10% or less, and could achieve a high ink discharge speed and a large ink discharge amount. The head 2 could suppress the mutual interference to 10% or less, but could not achieve a high ink discharge speed and a large ink discharge amount. The head 3 could suppress the mutual interference to 10% or less, but could not achieve a high ink discharge speed and a large ink discharge amount. With the head 4, the mutual interference exceeded 20%, and a high ink discharge speed and a large ink discharge amount could not be achieved.

In general, it is considered effective for increasing a displacement volume to increase the width of the base part of the part (first projection part 2*b*) bonded to the drive piezoelectric element pillar. Further, it is considered effective for increasing the rigidity of the non-drive part to increase the width of the base part of the part (second projection part 2*c*) bonded to the non-drive piezoelectric element pillar. In a case (head 4) in which both the widths are actually increased, the rigidity was improved, but the mutual interference was not suppressed. This result is considered to be caused for the following reason. By increasing the widths of the base parts of both the bonding parts, the width of the diaphragm part 2*a* that is relatively deformed was reduced. Therefore, the freedom of displacement was decreased, whereby the non-drive part was pulled by the deformation of the drive part.

According to these results, it became clear that the mutual interference cannot be suppressed only by reducing the width of the drive pillar and increasing the width of the non-drive pillar in the high density head having the nozzles aligned at about 600 dpi, and it is also important to control the widths of a surface bonded to the vibration plate member or of the base parts of the projection parts formed on the vibration plate member.

That is, by reducing the width of the base part of the part bonded to the non-drive piezoelectric element pillar to increase the diaphragm area, the mutual interference can be reduced. In this manner, it became clear that even when the width of the base part of the projection part of the vibration plate member, which is bonded to the non-drive pillar, is formed to be less than the width of the non-drive pillar, the non-drive pillar has an enough fixing function not to be deformed when the drive pillar is driven. This is considered to be because when the height of the projection part is sufficiently less than the height of the non-drive pillar, there is little reduction of rigidity.

Meanwhile, in the high density head, it is not enough to simply suppress the mutual interference. Since the volumes of the liquid chambers become smaller in order to achieve the high density, it is preferable that the head be configured with high discharge efficiency and capable of discharging large droplets in order to achieve high speed printing.

However, when the width of the base part of the projection part bonded to the drive pillar is equal to or less than the width of the base part of the projection part bonded to the non-drive pillar as in the configurations of the heads 2, 3 described above, the mutual interference can be suppressed, but the discharge efficiency cannot be increased. Therefore, such configurations cannot sufficiently perform the high speed printing.

Therefore, even when the width of the drive pillar is reduced, the discharge efficiency can be increased by increasing the width of the base part of the projection part bonded to the drive pillar of the vibration plate member. At the same time, even if the width of the base part of the projection part bonded to the non-drive pillar is reduced, the mutual interference can be suppressed and deformation of the vibration plate member responsive to a displacement of the drive pillar can be ensured by increasing the width of the non-drive pillar. Therefore, the discharge efficiency can be increased.

By forming the projection part of the vibration plate member in a mushroom shape, a contact area with the piezoelectric element pillar can be increased, and bonding can be reliably performed even for an arrangement of nozzles at a high density.

In this manner, in the vibration plate member, the first projection part bonded to the drive pillar is provided in a vibration area, and the second projection part bonded to the non-drive pillar is provided in a part corresponding to the partition wall between the liquid chambers. The width of a base part of the first projection part in the nozzle alignment direction is formed greater than the width of a base part of the second projection part in the nozzle alignment direction. Moreover, the width of the drive pillar in the nozzle alignment direction is formed to be less than the width of the non-drive pillar. With this configuration, even when the nozzles are arranged at a high density, a displacing area of the vibration area by the drive pillar can be increased, the mutual interference can be suppressed, and droplets can be discharged stably.

Figure 7:
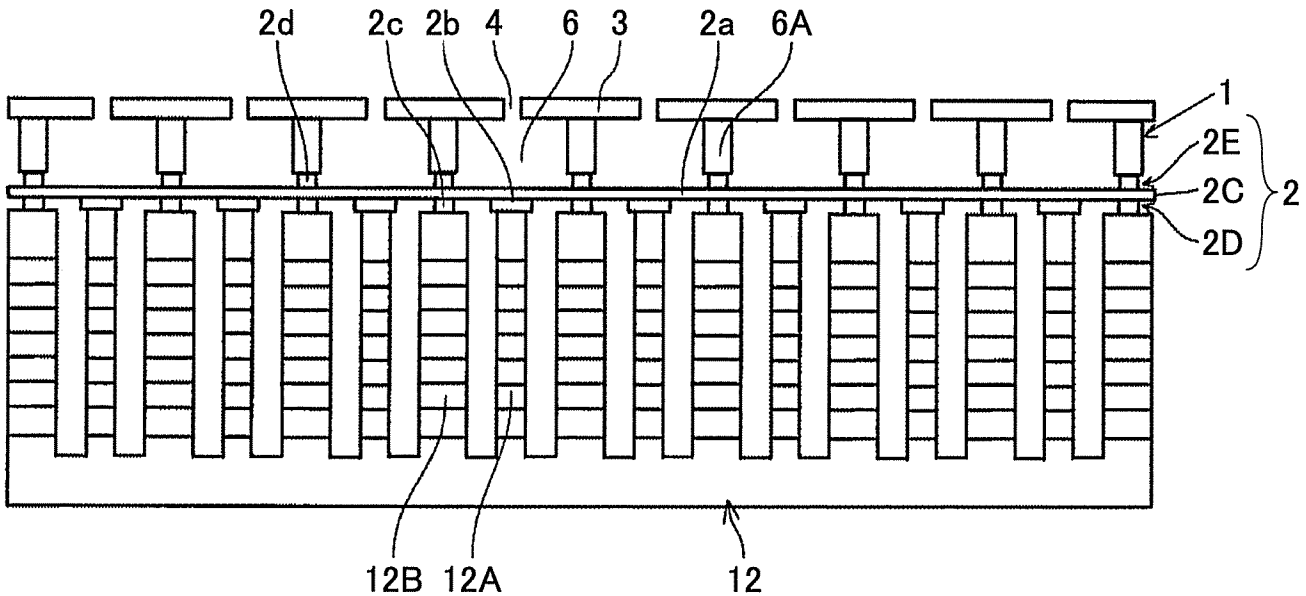
FIG. 7 is a cross-sectional view for describing a liquid discharge head according to a second embodiment of the present invention.

Next, a second embodiment of a liquid discharge head according to the present invention is described with reference to FIGS. 7 and 8. FIG. 7 is a cross-sectional view of the liquid discharge head, and FIG. 8 is an enlarged view of a main part of a vibration plate member of the liquid discharge head.

Here, in the vibration plate member 2, the first projection part 2*b* bonded to the drive piezoelectric element pillar 12A is formed on the diaphragm part 2*a*, the second projection part 2*c* bonded to the non-drive piezoelectric element pillar 12B is formed at a portion corresponding to the partition wall 6A between the liquid chambers, and a third projection part 2*d* bonded to the partition wall 6A between the liquid chambers is formed at a part corresponding to the partition wall 6A between the chambers.

Figure 8:
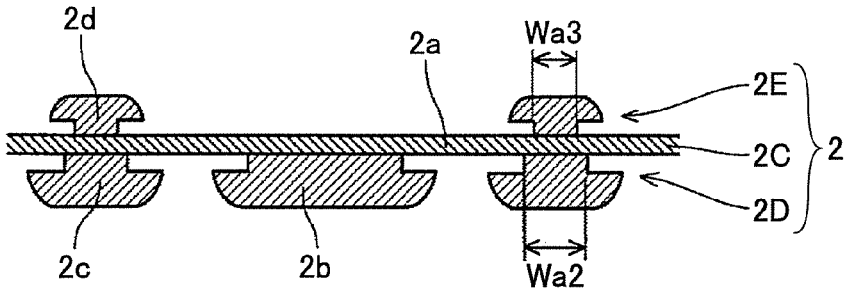
FIG. 8 is an enlarged cross-sectional view of a main part of the vibration plate member of the liquid discharge head illustrated in FIG. 7.

For example, as illustrated in FIG. 8, seed layers are formed on both sides of a polyimide film (first layer 2C which serves as an intermediate layer). The polyimide film has a thickness of 6 μm and forms the diaphragm part 2*a*. After performing a photolithography process on the seed layers, plating films are formed by performing nickel electrolytic plating, and then resists are peeled off. As a result, the vibration plate member 2 having the projection parts on both the surfaces can be obtained. In the formed vibration plate member 2, a second layer 2D that is formed of a plating film and forms the first and second projection parts 2*b* and 2*c*, and a third layer 2E that is formed of a plating film and forms the third projection part 2*d* are formed.

In this case, by forming the plating film with a thickness greater than that of the resist film, the projection parts have a mushroom-shaped cross section similar to those described above. Here, what is important in the width of the projection part is a width precision of a bottom part (base part) in a vicinity of the diaphragm part. By forming a thin resist film, variations in the width of the resist in the photolithography process can be drastically reduced. Therefore, the width of the bottom part that is important for the width of the projection part of the vibration plate member can be formed at high precision.

That is, in the high density head, bonding precisions among the members have a great influence on the discharge characteristics. In view of this, as in this embodiment, the third projection part is formed on the surface bonded to the channel member so as to oppose the second projection part bonded to the non-drive pillar of the vibration plate member. As a result, even when a bonding misalignment occurs between the vibration plate member 2 and the channel plate 1, the influence of the displacement characteristics of the drive piezoelectric element pillar on the change in pressure of the liquid chamber can be removed, whereby variations of droplet discharge characteristics can be drastically reduced.

In this case, by forming a width Wa3 of a base part of the third projection part 2*d* to be less than the width Wa2 of the base part of the second projection part 2*c* (Wa3<Wa2), the influence on the droplet discharge characteristics can be cancelled even when a slight misalignment occurs in forming the two projection parts (second and third projection parts 2*c*, 2*d*) one on each of the surfaces of the vibration plate members.

The diaphragm part 2*a* of the vibration plate member 2 is formed of a thin film for improving deformation characteristics. Therefore, by forming the second and third projection parts 2*c* and 2*d* of the same material one on each of the surfaces of the diaphragm part 2*a*, linear coefficients of expansion can be uniform; and bonding can be performed without generating warping of the vibration plate member 2 even if heating is performed in the bonding. Therefore, a bonding quality can be stabilized and variations of droplet discharge characteristics as a head can be reduced.

Figure 9:
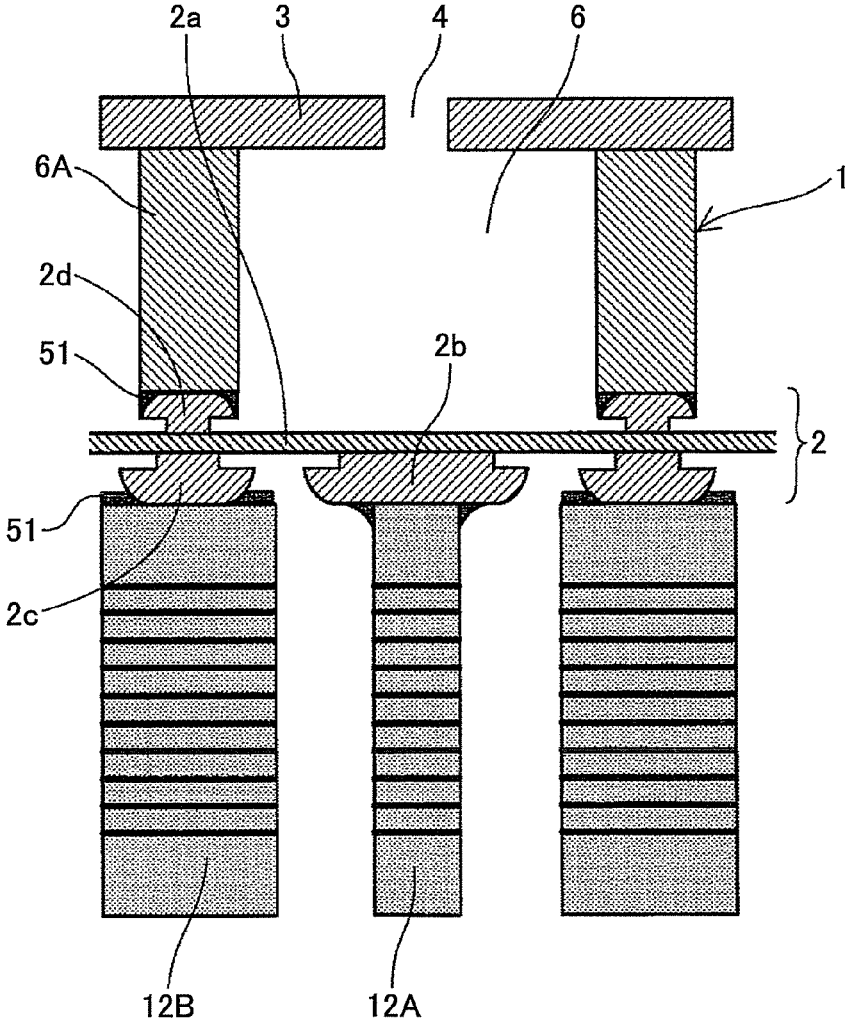
FIG. 9 is an enlarged view of one liquid chamber part of the liquid discharge head illustrated in FIG. 7.

As described above, by forming the projection parts 2*b*, 2*c*, and 2*d* with a mushroom-shaped cross section, there are the following advantages. As illustrated in FIG. 9, even when an adhesive 51 that bonds with the piezoelectric element pillars 12A and 12B of the piezoelectric member 12 and the channel plate 1 generates a protrusion (sticks out), the adhesive 51 can be prevented from being wet and spreading to the diaphragm part 2*a* of the vibration plate member 2, whereby variations in droplet discharge characteristics caused by bonding variations by the adhesive and the like can be suppressed.

Figure 10:
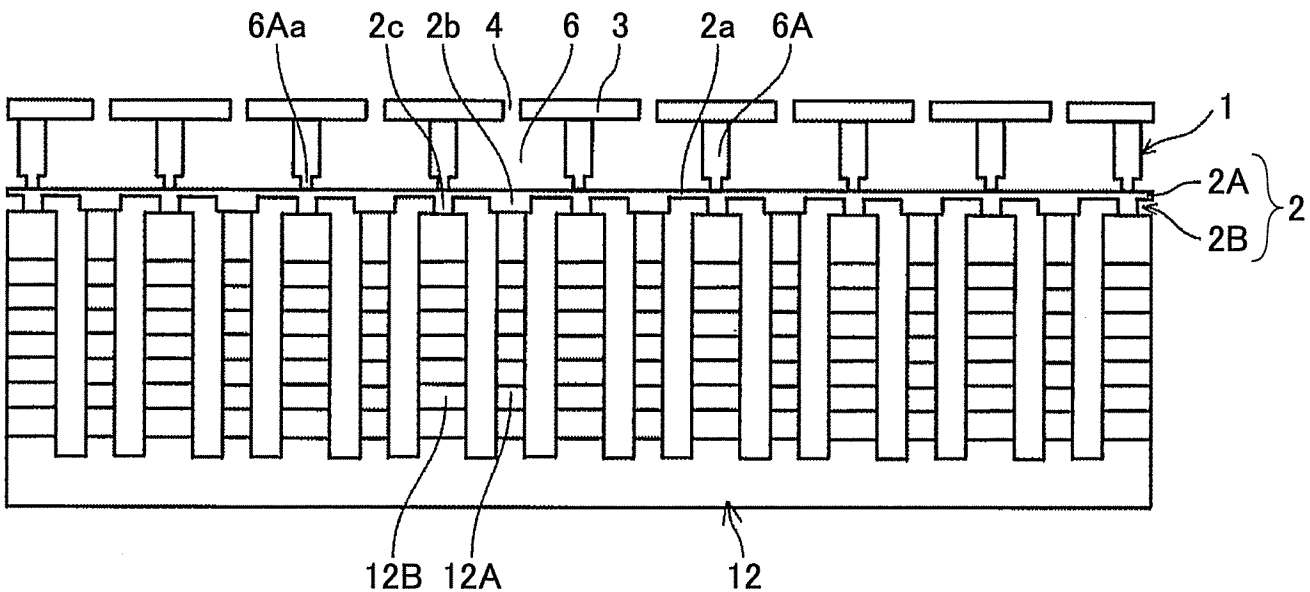
FIG. 10 is a cross-sectional view for describing a liquid discharge head according to a third embodiment of the present invention.

Next, a third embodiment of a liquid discharge head according to the present invention is described with reference to FIG. 10. FIG. 10 is a cross-sectional view of the liquid discharge head.

Here, the partition wall 6A between the liquid chambers of the channel plate 1 has a side 6Aa bonded to the vibration plate member 2. A width of the side 6Aa is less than a width of a side bonded to the nozzle plate 3 of the partition wall 6A. Such a channel plate 1 can be formed by, for example, etching using a single crystalline silicon substrate.

That is, the width of the partition wall 6A between the liquid chambers is required to be reduced in accordance with the increased density of the nozzles 4 of the head. However, if the width of the partition wall 6A is too narrow, the mutual interference occurs due to a deformation of the partition wall 6A caused in accordance with a fluctuation of pressure in the liquid chamber. Therefore, it is not preferable to form the width of the entire partition wall 6A thin. In view of this, by forming an end part of the partition wall 6A, which is a part bonded to the vibration plate member 2, to be narrow, fluctuation of the droplet discharge characteristics caused by a bonding misalignment between the channel plate 1 and vibration plate member 2 can be reduced, and the rigidity of the entire partition wall 6A can be maintained. Therefore, the mutual interference caused by the deformation of the partition wall 6A can be suppressed.

Figure 11:
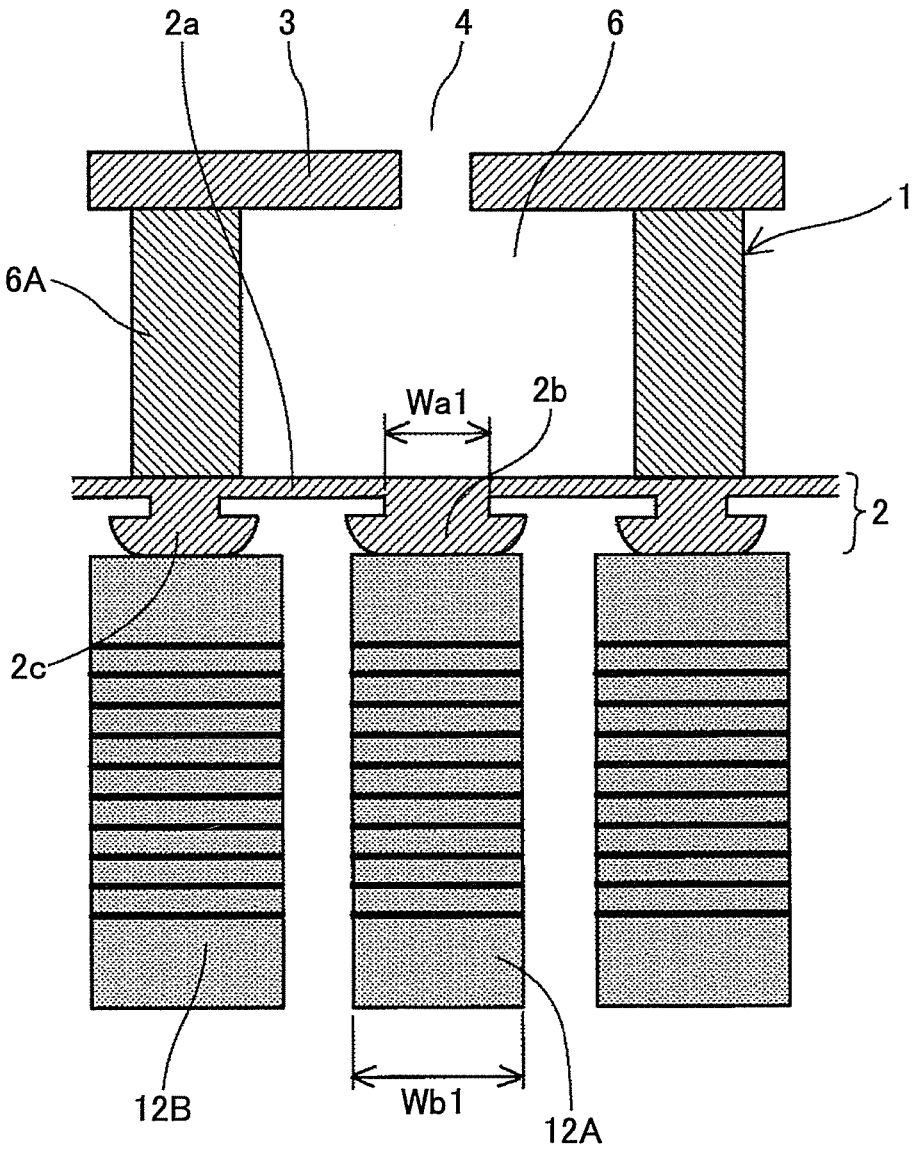
FIG. 11 is a cross-sectional view of one liquid chamber part for describing a liquid discharge head according to a fourth embodiment of the present invention.

Next, a fourth embodiment of a liquid discharge head according to the present invention is described with reference to FIG. 11. FIG. 11 is a cross-sectional view of one liquid chamber part of the liquid discharge head.

Here, the width Wa1 of the base part of the first projection part 2*b* and the width Wb1 of the drive piezoelectric element pillar 12A are in a relationship of Wa1≦Wb1.

In general, the piezoelectric element pillars are formed by forming grooves using a dicing saw, a wire saw, and the like. Therefore, a distance between the piezoelectric element pillars is defined by a width of a process blade, which is less than a width required for the displacement of the diaphragm part 2*a*. Therefore, if the sufficient width Wa1 can be obtained for the base part of the part 2*b* bonded to the drive pillar 12A, the widths are not required to be in the relationship of Wa1>Wb2. If a width of the groove is sufficiently less than the width of the piezoelectric element pillar, a similar effect to that of the first embodiment can be obtained by setting the widths in the relationships of Wa1>Wa2, and Wb1<Wb2.

Figure 12:
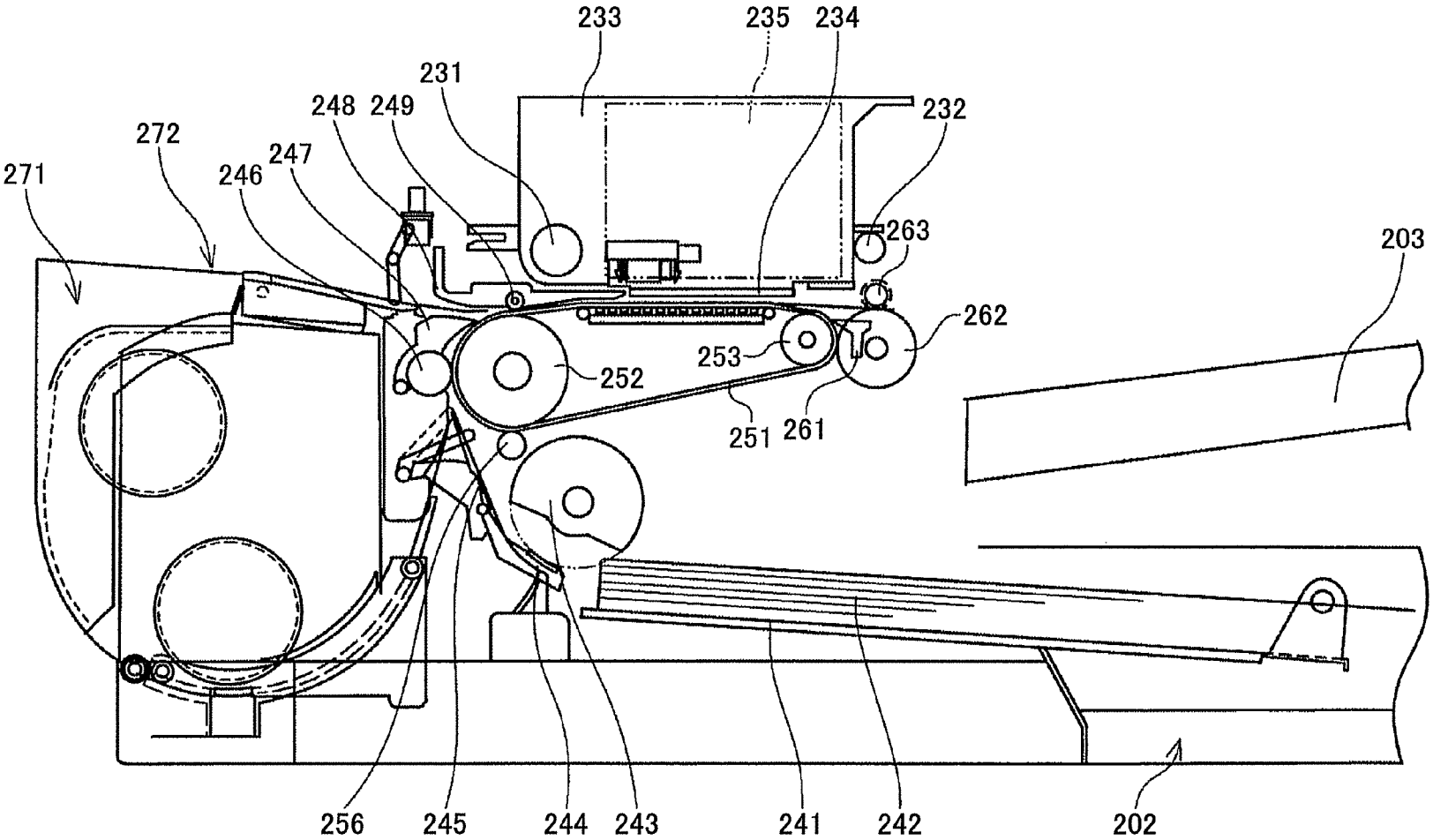
FIG. 12 is a schematic configuration diagram for describing an entire configuration of a mechanical part of an image forming apparatus according to the present invention.
Figure 13:
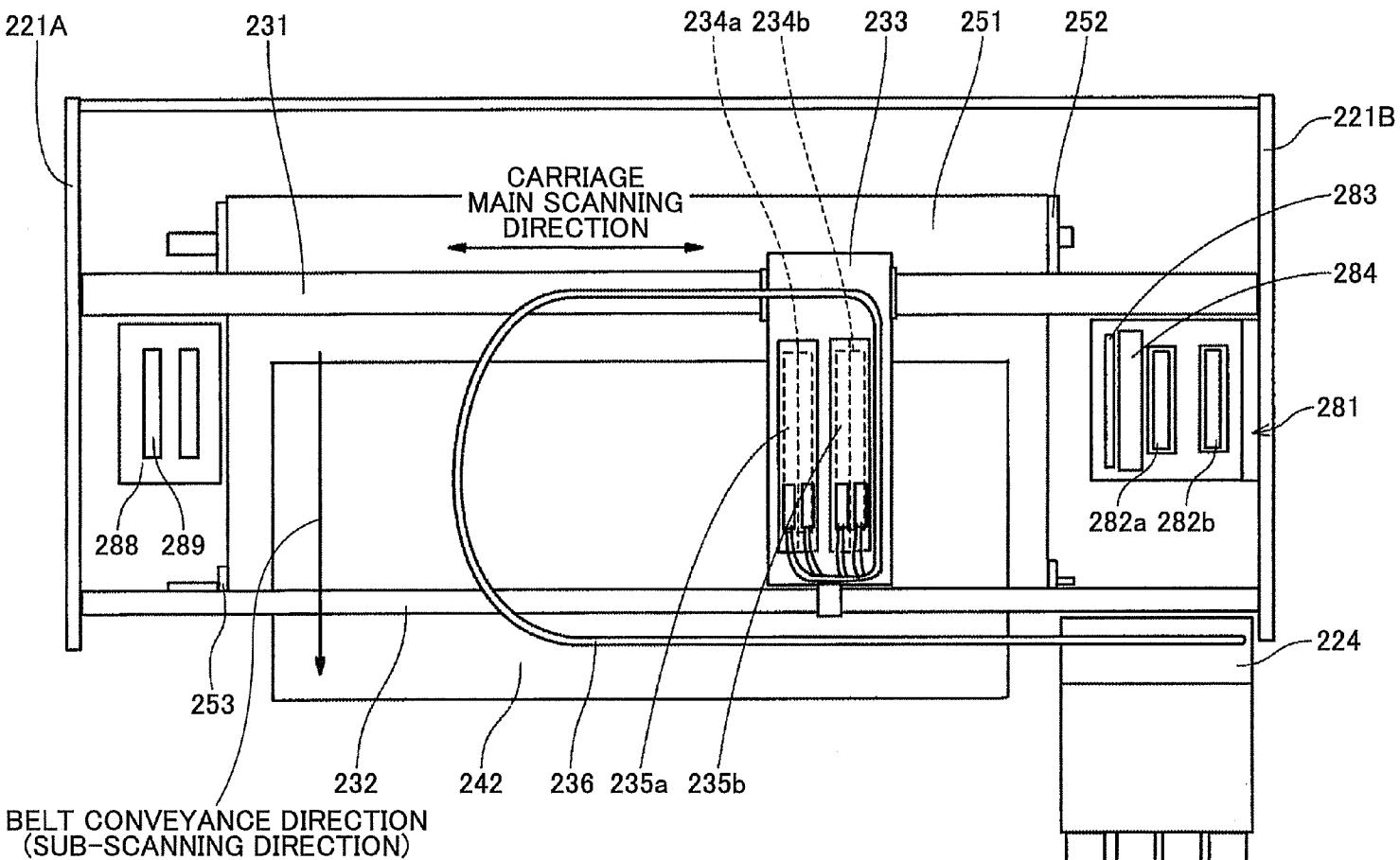
FIG. 13 is a plan view of a main part of the mechanical part illustrated in FIG. 12.

Next, an example of an image forming apparatus according to an embodiment of the present invention provided with the liquid discharge head according to an embodiment of the present invention is described with reference to FIGS. 12 and 13. FIG. 12 is a schematic configuration diagram for describing an entire configuration of a mechanical part of the image forming apparatus, and FIG. 13 is a plan view of a main part of the mechanical part.

This image forming apparatus is a serial type image forming apparatus. A carriage 233 is held slidably in a main scanning direction by master and slave guide rods 231 and 232 serving as guide members laid horizontally between left and right side plates 221A and 221B. By a main scanning motor (not illustrated), the carriage 233 is moved and scanned in a direction indicated by an arrow (carriage main scanning direction) via a timing belt.

In this carriage 233, a recording head 234 formed of a liquid discharge head unit according to an embodiment of the present invention for discharging ink droplets of respective colors of yellow (Y), cyan (C), magenta (M), and black (K) is mounted. The recording head 234 is mounted so that nozzle arrays formed of plural nozzles are aligned in a sub-scanning direction perpendicular to the main scanning direction and an ink droplet discharge direction faces downward.

The recording head 234 is formed by attaching liquid discharge heads 234*a* and 234*b*, each of which includes two nozzle arrays, to one base member. One of the nozzle arrays of the head 234*a* discharges black (K) liquid droplets while the other nozzle array of the head 234*a* discharges cyan (C) liquid droplets. One of the nozzle arrays of the head 234*b* discharges magenta (M) liquid droplets while the other nozzle array of the head 234*b* discharges yellow (Y) liquid droplets. Note that the two heads are used to discharge the droplets of four colors here; however, liquid discharge heads may be provided for all the respective colors as well.

The carriage 233 supports sub-tanks 235*a* and 235*b* (referred to as "sub-tank 235" when the sub-tanks are not distinguished from each other) for supplying ink of respective colors corresponding to the nozzle arrays of the recording head 234. The sub-tanks 235 of the respective colors are refilled with ink supplied from ink cartridges 210 of the respective colors by a supply unit 224 via supply tubes 236 of the respective colors.

Meanwhile, as a sheet feed part for feeding a sheet 242 stacked on a sheet stack part (pressure plate) 241 of a sheet feed tray 202, a half-moon-shaped roller (sheet feed roller) 243 and a separation pad 244 facing the sheet feed roller 243 are provided. The half-moon-shaped roller 243 separates and feeds the sheets 242 one by one from the sheet stack part 241. The separation pad 244 is formed of a material with a high friction coefficient. This separation pad 244 is biased to the sheet feed roller 243 side.

In order to send the sheet 242 fed from this sheet feed part to a lower side of the recording head 234, a guide member 245 for guiding the sheet 242, a counter roller 246, a conveyance guiding member 247, and a pressing member 248 including a leading end pressing roller 249 are provided. In addition, a conveyance belt 251 is provided as a conveyance unit for attracting the fed sheet 242 by static electricity and conveying the sheet 242 at a position facing the recording head 234.

This conveyance belt 251 is an endless belt stretched between a conveyance roller 252 and a tension roller 253 so as to revolve in a belt conveyance direction (sub-scanning direction). In addition, a charge roller 256 serving as a charging unit for charging a surface of the conveyance belt 251 is provided. The charging roller 256 is arranged to contact the surface of the conveyance belt 251 and rotate following a rotational movement of the conveyance belt 251. The conveyance belt 251 is moved in a revolving manner in the belt conveyance direction by a rotational driving of the conveyance roller 252 via timing by a sub-scanning motor (not illustrated).

As a sheet discharge part for discharging the sheet 242 recorded on by the recording head 234, a separation claw 261 for separating the sheet 242 from the conveyance belt 251, a sheet discharge roller 262, and a sheet discharge roller 263 are provided, and a sheet discharge tray 203 is provided downstream of the sheet discharge roller 262.

On a back surface part of the apparatus body, a double-side unit 271 is detachably mounted. The double-side unit 271 takes in the sheet 242 returned by a reverse rotation of the conveyance belt 251, inverts the sheet 242, and feeds the sheet 242 between the counter roller 246 and the conveyance belt 251 again. An upper surface of the double-side unit 271 functions as a manual feed tray 272.

In a non-printing area on one side of the scanning direction of the carriage 232, a maintenance recovery mechanism 281 for maintaining and recovering the states of the nozzles of the recording head 234 is arranged. This maintenance recovery mechanism 281 includes respective cap members (hereinafter referred to as "caps") 282*a* and 282*b* (referred to as "cap 282" when the caps are not distinguished from each other) for capping the respective nozzle surfaces of the recording head 234, a wiper blade 283 serving as a blade member for wiping the nozzle surfaces, an empty discharge receiver 284 for receiving liquid droplets generated by an empty discharge by which liquid droplets that do not contribute to recording are discharged for evacuating thickened ink, and the like.

In a non-printing area on the other side of the scanning direction of the carriage 223, an empty discharge receiver 288 is arranged. The empty discharge receiver 288 receives liquid droplets generated by an empty discharge by which liquid droplets that do not contribute to recording are discharged for evacuating thickened ink during the recording and the like. The empty discharge receiver 288 is provided with an opening part 289 formed along the nozzle alignment direction of the recording head 234, and the like.

In the image forming apparatus configured in this manner, the sheet 242 is separated and fed one by one from the sheet feed tray 202, the sheet 242 fed substantially vertical upward is guided by the guide 245 and conveyed while being sandwiched between the conveyance belt 251 and the counter roller 246. Further, a leading end of the sheet 242 is guided by the conveyance guiding member 247 and pressed by the leading end pressing roller 249 to the conveyance belt 251, whereby a conveyance direction is shifted by approximately 90°.

At this time, a plus voltage output and a minus voltage output are alternately repeated; namely, an alternating voltage is applied to the charging roller 256. As a result, the conveyance belt 251 is charged by an alternating charging voltage pattern; that is, the conveyance belt 251 is alternately charged with the plus and minus charges at predetermined widths in a band shape in the sub-scanning direction which is a revolving direction. When the sheet 242 is fed onto the conveyance belt 251 which is charged alternately with the plus and minus charges, the sheet 242 is attracted by the conveyance belt 251 and conveyed in the sub-scanning direction by the revolving movement of the conveyance belt 251.

By driving the recording head 234 in response to image signals while moving the carriage 233, ink droplets are discharged on the stationary sheet 242 to record one line, and the next line is recorded after conveying the sheet 242 for a predetermined amount. Upon receiving a recording end signal or a signal of arrival of a rear end of the sheet 242 at a recording area, the recording operation is finished and the sheet 242 is discharged to the sheet discharge tray 203.

In this manner, this image forming apparatus has the liquid discharge head according to embodiments of the present invention as the recording head. Therefore, a high quality image can be formed at high speed by using a high density head in which nozzles are arranged at a high density, as the recording head.

Figure 14:
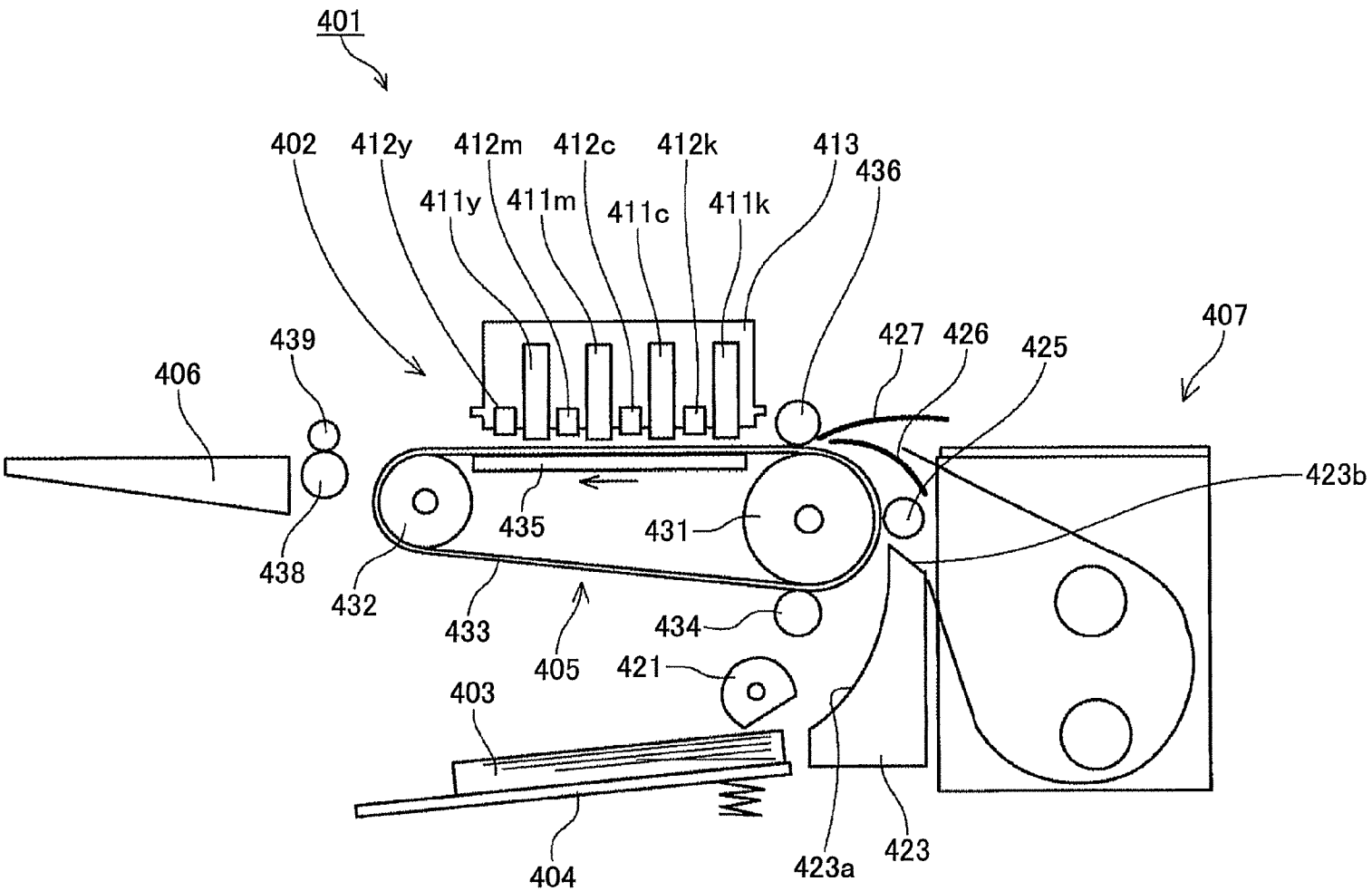
FIG. 14 is an overall configuration diagram showing another example of an image forming apparatus according to the present invention.

Next, another example of the image forming apparatus according to the present invention provided with the liquid discharge head according to the present invention is described with reference to FIG. 14. Note that FIG. 14 is a schematic configuration diagram of an entire mechanical part of the image forming apparatus.

This image forming apparatus is a line type image forming apparatus. Inside an apparatus body 401 of the image forming apparatus, an image forming part 402 and the like are provided. A sheet feed tray 404 in which multiple recording media (sheets) 403 can be stacked is provided on a lower side of the apparatus body 401. The sheet 403 fed from the sheet feed tray 403 is taken in and conveyed by a conveyance mechanism 405. While the sheet 403 is conveyed, a desired image is recorded by the image forming part 402. After the image is recorded, the sheet 403 is discharged to a sheet discharge tray 406 mounted lateral to the apparatus body 401.

Further, a double-side unit 407 which is detachable with respect to the apparatus body 401 is provided. When printing both sides of the sheet 403, after one surface (front surface) of the sheet 403 is printed, the sheet 403 is conveyed in a reverse direction by the conveyance mechanism 405 to be taken into the double-side unit 407, whereby the sheet 403 is inverted and sent to the conveyance mechanism 405 again as the other surface (back surface) set as a printable surface. After the other surface (back surface) is printed, the sheet 403 is discharged to the sheet discharge tray 406.

Here, the image forming part 402 is provided with, for example, recording heads 411*k*, 411*c*, 411*m*, and 411*y* (referred to as "recording head 411" when colors are not distinguished from each other). The recording heads 411*k*, 411*c*, 411*m*, and 411*y* are formed of four full-line type liquid discharge heads according to the present invention, which discharge liquid droplets of the respective colors of black (K), cyan (C), magenta (M), and yellow (Y). Each of the recording heads 411 is mounted on a head holder 413 with a nozzle surface on which nozzles for discharging liquid droplets are formed facing downward.

For the respective recording heads 411, maintenance recovery mechanisms 412*k*, 412*c*, 412*m*, and 412*y* (referred to as "maintenance recovery mechanism 412" when the colors are not distinguished from each other) for maintaining and recovering the performance of the heads 411 are provided. The recording heads 411 and maintenance recovery mechanisms 412 are relatively moved in an operation to maintain the performance of the heads 411, such as a purge process and a wiping process, so that the nozzle surfaces of the recording heads 411 face a capping member and the like that constitute the maintenance recovery mechanism 412.

Here, the recording heads 411 are arranged so as to discharge the liquid droplets of the respective colors of black, cyan, magenta, and yellow in this order from an upstream side of the sheet conveyance direction. However, the arrangement and the number of colors are not limited to these. As the line-type head, one or plural heads having plural nozzle arrays provided at a predetermined interval for discharging liquid droplets of the respective colors can be used. The head and a liquid cartridge for supplying ink to this head can be integrated or separately provided.

The sheets 403 in the sheet feed tray 404 are separated one by one by a separation pad (not illustrated) and a feed sheet roller (half-moon-shaped roller) 421 to be fed into the apparatus body 401. The sheet 403 is then sent between a resist roller 425 and a conveyance belt 433 along a guide surface 423*a* of a conveyance guide member 423, and sent to the conveyance belt 433 of the conveyance mechanism 405 via a guide member 426 at a predetermined timing.

Further, a guide surface 423*b* for guiding the sheet 403 sent out from the double-side unit 407 is formed in the conveyance guide member 423. Further, a guide member 427 for guiding the sheet 403 that is returned from the conveyance mechanism 405 at the time of double-side printing into the double-side unit 407 is also provided.

The conveyance mechanism 405 includes the endless conveyance belt 433 stretched between a conveyance roller 431 serving as a driving roller and a follower roller 432, a charging roller 434 for charging the conveyance belt 433, a platen member 435 for maintaining planarity of the conveyance belt 433 at a position facing the image forming part 402, and a pressing roller 436 for pressing the sheet 403 to be sent out from the conveyance belt 433 to the conveyance roller 431 side. In addition, although not illustrated, a cleaning roller formed of a porous body and the like, which serves as a cleaning unit for removing ink attached to the conveyance belt 433, and the like are included in the conveyance mechanism 405.

On a downstream side of this conveyance mechanism 405, a sheet discharge roller 438 and a spur 439 for sending out the sheet 403 on which an image is recorded to the sheet discharge tray 406 are provided.

In the image forming apparatus configured in this manner, the conveyance belt 433 moves in a revolving manner in a direction indicated by an arrow. The conveyance belt 433 is charged by contacting the charging roller 434 to which a voltage at a high potential is applied. When the sheet 403 is fed on the conveyance belt 433 charged at the high potential, the sheet 403 is attracted onto the conveyance belt 433 by static electricity. In this manner, warping, depression, and projection of the sheet 403 strongly attracted onto the conveyance belt 433 are corrected, whereby a highly plane surface of the sheet 403 is formed.

By moving the sheet 403 by revolving the conveyance belt 433 and discharging liquid droplets from the recording head 411, a desired image is formed on the sheet 403. The sheet on which the image is recorded is discharged by the sheet discharge roller 438 to the sheet discharge tray 406.

In this manner, since this image forming apparatus has a recording head formed of the liquid discharge head according to embodiments of the present invention, a high quality image can be formed at high speed by using a recording head in which nozzles are arranged at a high density.

Note that the examples in which the present invention is applied to the image forming apparatus with a printer configuration have been described in this embodiment; however, the application of the present invention is not limited to the image forming apparatus with the printer configuration. For example, the present invention can be applied to image forming apparatuses such as a printer, a facsimile, a copier, and a multifunction peripheral of these apparatuses. Further, the present invention can be applied to an image forming apparatus using liquids other than strictly ink, a fixing processing solution, and the like.

According to at least one embodiment, in a liquid discharge head, the first projection part bonded to the drive pillar is provided on the vibration area, and the second projection part bonded to the non-drive pillar is provided in the part corresponding to the partition wall between the liquid chambers. The width in the nozzle alignment direction of the base part of the first projection part is greater than the width in the nozzle alignment direction of the base part of the second projection part. The width of the driver pillar in the nozzle alignment direction is less than the width of the non-drive pillar. Therefore, even when the nozzles are arranged at a high density, a displacement area of the vibration area displaced by the drive pillar can be increased, the mutual interference can be suppressed, and droplets can be discharged stably.

According to at least one embodiment, an image forming apparatus includes the liquid discharge head according to the present invention. Therefore, a high quality image can be formed by stably discharging droplets.

Although the invention has been described with respect to specific embodiment for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2010-041826 filed on Feb. 26, 2010, the entire contents of which are hereby incorporated herein by reference.

What is claimed is:

1. A liquid discharge head comprising:

plural nozzles configured to discharge liquid droplets;

plural liquid chambers in communication with the respective nozzles;

a vibration plate member having a deformable vibration area configured to form a part of a wall surface of the liquid chambers, a first projection part provided in the deformable vibration area, and a second projection part provided in a part corresponding to a partition wall between the liquid chambers; and a piezoelectric member having a drive pillar and a non-drive pillar, the drive pillar being bonded to the first projection part, and the non-drive pillar being bonded to the second projection part, wherein a width in a direction in which the nozzles are aligned of a base part of the first projection part is greater than a width in the direction in which the nozzles are aligned of a base part of the second projection part, and a width in the direction in which the nozzles are aligned of the drive pillar is less than a width in the direction in which the nozzles are aligned of the non-drive pillar, and wherein the width in the direction in which the nozzles are aligned of the base part of the first projection part is greater than the width in the direction in which the nozzles are aligned of the drive pillar, and the width in the direction in which the nozzles are aligned of the base part of the second projection part is less than the width in the direction in which the nozzles are aligned of the non-drive pillar.

2. The liquid discharge head as claimed in claim 1, wherein a width in the direction in which the nozzles are aligned of the partition wall is less on the vibration plate member side than a width in the direction in which the nozzles are aligned of the partition wall on another side opposite to the vibration plate member side.

3. An image forming apparatus comprising the liquid discharge head as claimed in claim 1.

4. The liquid discharge head as claimed in claim 1, wherein the vibration plate member has a third projection part formed on a same side of the vibration plate member as a side to which the partition wall between the liquid chambers is bonded.

5. The liquid discharge head as claimed in claim 1, wherein a width in the direction in which the nozzles are aligned of a base part of the third projection part is equal to or less than the width in the direction in which the nozzles are aligned of the base part of the second projection part.

6. The liquid discharge head as claimed in claim 1, wherein the second projection part and the third projection part are formed of a same material.

7. The liquid discharge head as claimed in claim 1, wherein the second projection part and the third projection part are formed of a plating film.

8. A liquid discharge head comprising:

plural nozzles configured to discharge liquid droplets;

plural liquid chambers in communication with the respective nozzles;

a vibration plate member having a deformable vibration area configured to form a part of a wall surface of the liquid chambers, a first projection part provided in the deformable vibration area, and a second projection part provided in a part corresponding to a partition wall between the liquid chambers; and a piezoelectric member having a drive pillar and a non-drive pillar, the drive pillar being bonded to the first projection part, and the non-drive pillar being bonded to the second projection part, wherein a width in a direction in which the nozzles are aligned of a base part of the first projection part is greater than a width in the direction in which the nozzles are aligned of a base part of the second projection part, and a width in the direction in which the nozzles are aligned of the drive pillar is less than a width in the direction in which the nozzles are aligned of the non-drive pillar, and wherein the vibration plate member has a third projection part formed on a same side of the vibration plate member as a side to which the partition wall between the liquid chambers is bonded.

9. The liquid discharge head as claimed in claim 8, wherein a width in the direction in which the nozzles are aligned of a base part of the third projection part is equal to or less than the width in the direction in which the nozzles are aligned of the base part of the second projection part.

10. The liquid discharge head as claimed in claim 8, wherein the second projection part and the third projection part are formed of a same material.

11. The liquid discharge head as claimed in claim 8, wherein the second projection part and the third projection part are formed of a plating film.

* * * * *